US005146411A

United States Patent [19]

Faber et al.

[11] Patent Number: 5,146,411

[45] Date of Patent: Sep. 8, 1992

[54] COMPUTER-AIDED PROCESS FOR PLACEMENT OF CRT TRIM MAGNETS

[75] Inventors: Brenda G. Faber, Loveland, Colo.; Louis A. Jansen, Chapel Hill, N.C.

[73] Assignee: International Business Machines Corporation, Armonk, N.Y.

[21] Appl. No.: 529,289

[22] Filed: May 29, 1990

[51] Int. Cl.[5] ..... H01J 9/44; H01J 29/70

[52] U.S. Cl. ..... 364/480; 364/468; 364/552; 315/368.24; 358/242

[58] Field of Search ..... 358/242, 243, 139, 10; 340/720; 315/368; 364/480, 481, 488, 552, 468

[56] References Cited

U.S. PATENT DOCUMENTS

| | | | |
|---|---|---|---|
| 3,748,526 | 7/1973 | Wedam | 315/368 |
| 4,211,960 | 7/1980 | Barten et al. | 315/368 |
| 4,220,897 | 9/1980 | Barten et al. | 315/368 |
| 4,636,694 | 1/1987 | DePaolis et al. | 315/368 |
| 4,641,062 | 3/1987 | Pons | 315/368 |
| 4,654,706 | 3/1987 | Davidson et al. | 358/139 |
| 4,754,329 | 6/1988 | Lindsay et al. | 358/139 |
| 4,896,071 | 1/1990 | Pons | 313/428 |
| 4,897,721 | 1/1991 | Young et al. | 358/139 |

*Primary Examiner*—Parshotam S. Lall
*Assistant Examiner*—Thomas S. Auchterlonie
*Attorney, Agent, or Firm*—Gerald R. Woods

[57] ABSTRACT

A computer-aided process for calculating the orientation and strength of trim magnetic fields for a monochrome CRT uses a machine vision camera to establish the shape of the uncorrected raster. Using the distortion information and sensitivity mappings representing the effect of a single trim magnet on a raster, a linear optimization technique is employed to compute the strength and orientation of each magnetic field which must be used to correct for raster distortions.

6 Claims, 5 Drawing Sheets

(UNCORRECTED VIDEO RASTER AREA)

(LEAST-SQUARES SOLUTION FOR CORRECTING VIDEO RASTER AREA)

(CORRECTED VIDEO RASTER AREA)

COMPUTER-AIDED PROCESS FOR PLACEMENT OF CRT TRIM MAGNETS

FIELD OF THE INVENTION

The present invention relates to cathode ray tube (CRT) displays and more particularly to a computer-aided process for placing trim magnets on monochrome cathode ray tubes to reduce or eliminate pin cushion distortion in the video raster.

DESCRIPTION OF THE PRIOR ART

In a typical CRT display, horizontal and vertical deflection signals are applied to windings on a deflection yoke on the neck of the cathode ray tube to deflect an electron beam produces both horizontally and vertically. Ideally, the deflected electron beam produces a rectangular video raster area on the faceplate of the cathode ray tube. In reality, pin cushion distortion causes a non-rectangular video raster area unless some form of compensation is provided.

The term pin cushion distortion is derived from the observation that the video raster area takes the general shape of a pin cushion with curved concave edges terminating in extended, pointed corners. Pin cushion distortion results from the fact that the corners of a cathode ray tube faceplate are further from the deflection center of an electron beam than the mid-screen area. The increased distance causes the beam to move more both horizontally and vertically at the corners of the screen than at mid-screen. The amount of pin cushion distortion is related both to the deflection angle of the beam and to the overall size of the CRT faceplate.

Pin cushion distortion in a monochrome cathode ray tube can be corrected by the use of trim magnets, which are small, permanent magnets embedded in the front part of the housing of the deflection yoke. As many as twelve permanent magnets may be used to correct for pin cushioning distortions. The standard approach for placing trim magnets is an iterative, somewhat trial and error approach. An operator typically positions one or two trim magnets on the housing at a time, pauses to see what effect those magnets have on the video raster and then proceeds to place additional magnets. The operator may follow certain rules, either formal or intuitive, in determining magnet placement at each stage of the iterative process.

A major drawback of an iterative approach is that it takes time to complete the successive iterations needed to fully correct for pin cushioning distortion. Moreover, for the iterative process to work effectively, each operator must be trained to understand the complicated steps in the adjustment sequence. Some subtle correction combinations can be learned only through on-the-job experience. Some operators never develop the necessary skills for correcting unusual distortions.

Furthermore, a catastrophically faulty cathode ray tube assembly (one which cannot be adjusted with any number of trim magnets or any number of iterations) is often not identified until a significant amount of time has been spent trying to implement corrections. Since a catastrophically faulty cathode ray tube assembly must be reworked or scrapped, that time is wasted.

SUMMARY OF THE INVENTION

The present invention is a computer-aided process for determining the proper placement of trim magnets in a monochrome cathode ray tube device. The placement information may be communicated to an operator who will manually install the magnets or, in a fully automated operation, to a robotic device which will position and install the needed trim magnets.

In accordance with the invention, a cathode ray tube device lacking trim magnets is energized to produce an uncorrected video raster. Edge distortions in the uncorrected video raster are detected, preferably using a machine vision camera. A distortion correction algorithm is used to process the detected edge distortion information to calculate the strength and orientation of each trim magnet required to minimize the edge distortion. The results of the calculation are communicated to an operator responsible for physical installation of the necessary trim magnets. In one embodiment, the operator may be a robotic device.

BRIEF DESCRIPTION OF THE DRAWINGS

While this specification concludes with claims particularly pointing out and distinctly claiming that which is regarded as the present invention, details of preferred embodiments of the invention may be more readily ascertained from the following detailed description when read in conjunction with the accompanying drawings wherein:

DETAILED DESCRIPTION

Figure 1:
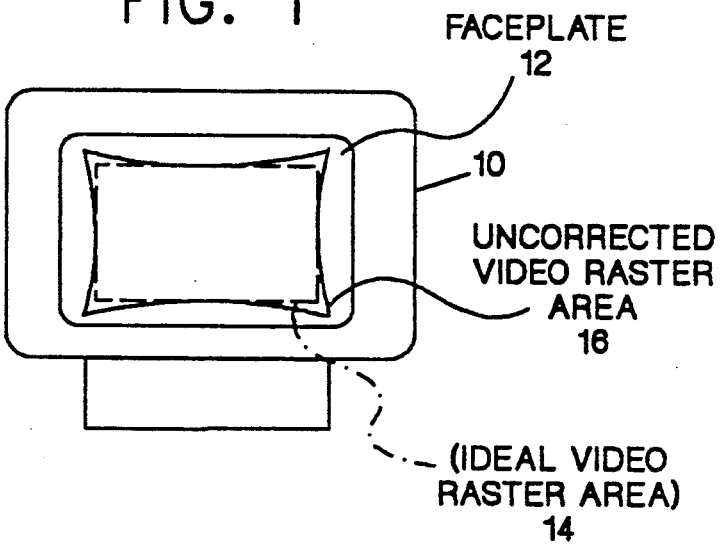
FIG. 1 represents both an ideal video raster and a more realistic uncorrected video raster on a CRT faceplate.

FIG. 1 is a plan view of a typical cathode ray tube or CRT display 10 including a CRT glass faceplate 12 on which a video image is generated. The video image is presented in a video raster which ideally has a rectangular configuration 14. As noted earlier, the ideal rectangular configuration cannot be achieved without correcting for pin cushion distortion which, without compensation, generates the generally pillow-shaped video raster 16 shown on the CRT faceplate 12.

Figure 2:
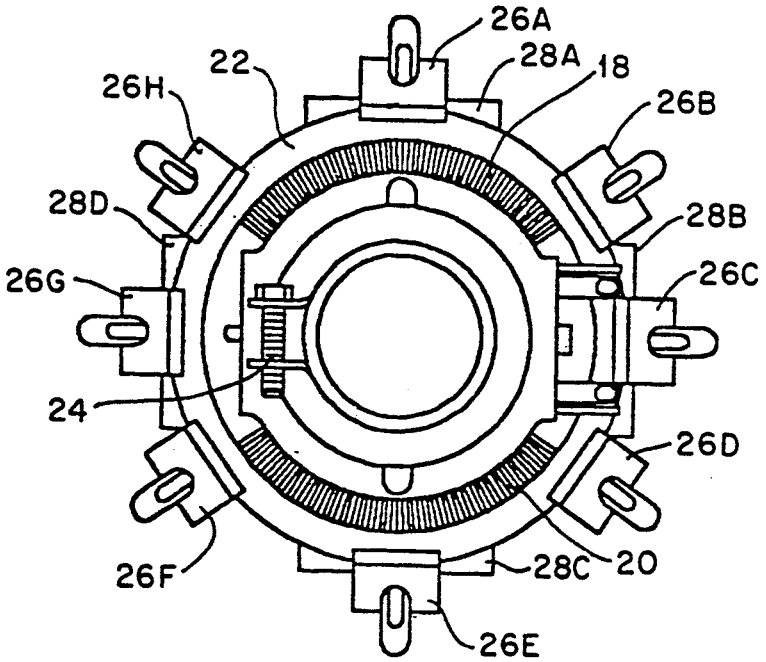
FIG. 2 illustrates a typical cathode ray tube deflection yoke assembly with trim magnets.

Referring to FIG. 2, distortion correction is achieved by imbedding permanent magnets, often referred to as bar and trim magnets, on the housing for a deflection yoke mounted on the neck of the cathode ray tube. FIG. 2 is a plan view showing of a deflection yoke assembly including windings 18 and 20 and a housing 22. The deflection yoke assembly is clamped to the cylindrical neck of the cathode ray tube with a clamp arrangement 24. The yoke assembly includes up to eight trim magnets 26A through 26G secured to the housing 22. The yoke assembly may also include up to four bar magnets 28A through 28D. The relative strength and orientation of each of these magnets is selected for the purpose of offsetting distortions in the video raster with the goal of achieving a rectangular video raster.

The present invention is not concerned with the details of the yoke assembly. A conventional yoke assembly is assumed. The present invention relates to a method and apparatus for determining the strength and relative orientation of the magnets embedded in the yoke assembly to provide distortion correction.

Referring to FIGS. 3–10, the correction process utilizes what are known as sensitivity mappings, a term which defines the impact on a video raster of a single permanent magnet mounted at a given position on the yoke in a specific orientation. A sensitivity map is obtained by first identifying key points along an uncorrected video raster. When a single permanent magnet is added to the deflection yoke, the effect of that magnet is mapped by recording vector movement of the raster at the key points; that is, by determining how the edges of the raster area change. Sensitivity mapping for each key point is expressed in terms of video movement per unit strength of permanent magnet for a given magnet configuration.

Figure 3:
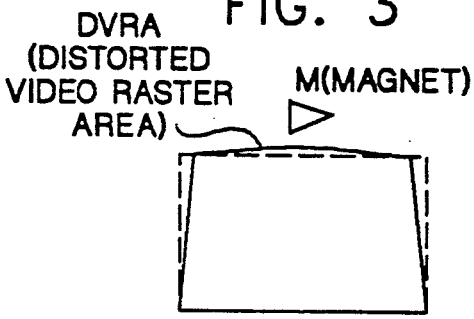
FIGS. 3–10 illustrate the effect on a video raster of trim magnets located in different positions and different orientations.
Figure 4:
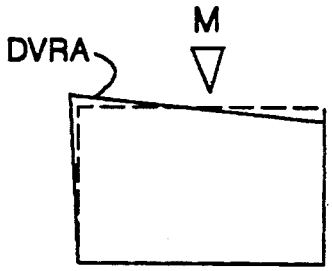
Figure 5:
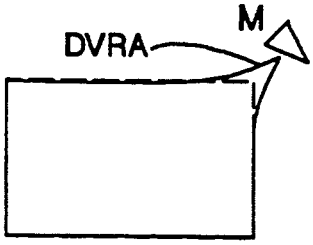
Figure 6:
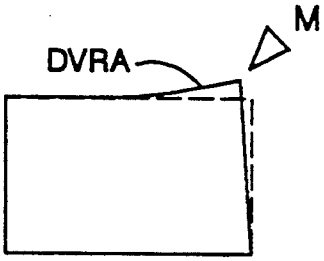
Figure 7:
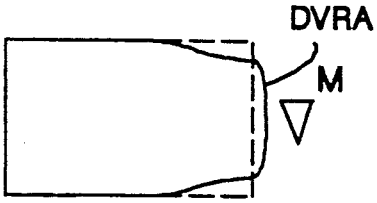
Figure 8:
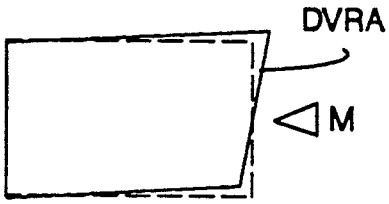
Figure 9:
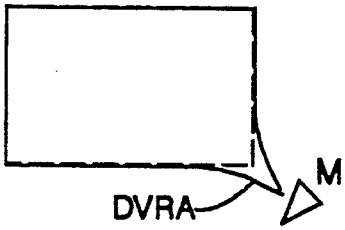
Figure 10:
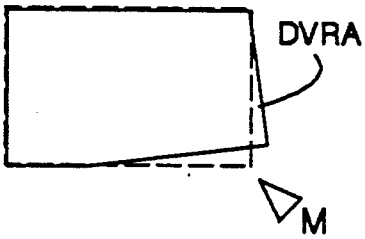

FIGS. 3–10 have several things in common. Each shows a rectangular video raster area and the location and orientation of a single magnet, represented by an arrowhead M. The direction of the arrowhead indicates the direction of the north pole of the magnet. Each figure also shows the effect on the video raster area VRA of the magnet. For example, FIG. 3 shows the effect of placing a trim magnet with a rightward facing north pole in the position of magnet 26A in the yoke assembly shown in FIG. 2. A magnet in this position tends to bow the video raster lines upwardly while causing both ends of the lines to converge. If a magnet in position 26A is oriented with the downwardly facing north pole, the effect on the video raster is illustrated by the solid line in FIG. 4. FIGS. 5 and 6 show the effect of magnets with two different orientations in the position of magnet 26B. FIGS. 7 and 8 show the effect of magnets in position 26B, while FIGS. 9 and 10 show the effect of magnets in position 26D.

Two things should be noted about the sensitivity mappings. First, placing a magnet directly opposite from one of the yoke positions shown in FIGS. 3 through 10 will cause the distortion effects to be reversed. For example, with respect to FIG. 3, if the magnet were placed in position 26E (FIG. 2) with the north pole oriented to the left, the video raster would bulge downwardly while its edges would converge in a downward direction.

Secondly, if the magnet remains in the same position, and its orientation is reversed, the resulting distortion will approximate a negative reflection of the previously induced distortion. Referring to FIG. 4 as an example, if the magnet were placed with the north pole pointing up (rather than down, as illustrated), the upper edge of the video raster would have a positive slope, rather than the illustrated negative slope. Hence, the sensitivity mappings which represent a reversed magnet can be approximated by negating the sensitivity values associated with the original magnet.

The sensitivity mappings for a particular display model can be determined empirically. A "training" session can be conducted in which a computer vision system is used to perform a series of edge distortion measurements as an operator systematically moves a magnet of known strength through the 0° and 90° orientations at each of the yoke post positions. As the magnet is placed at each position and in each orientation, the computer will record the movement of key points along the raster. The resulting sets of sensitivity values would be stored in a data base for later access.

Figure 11:
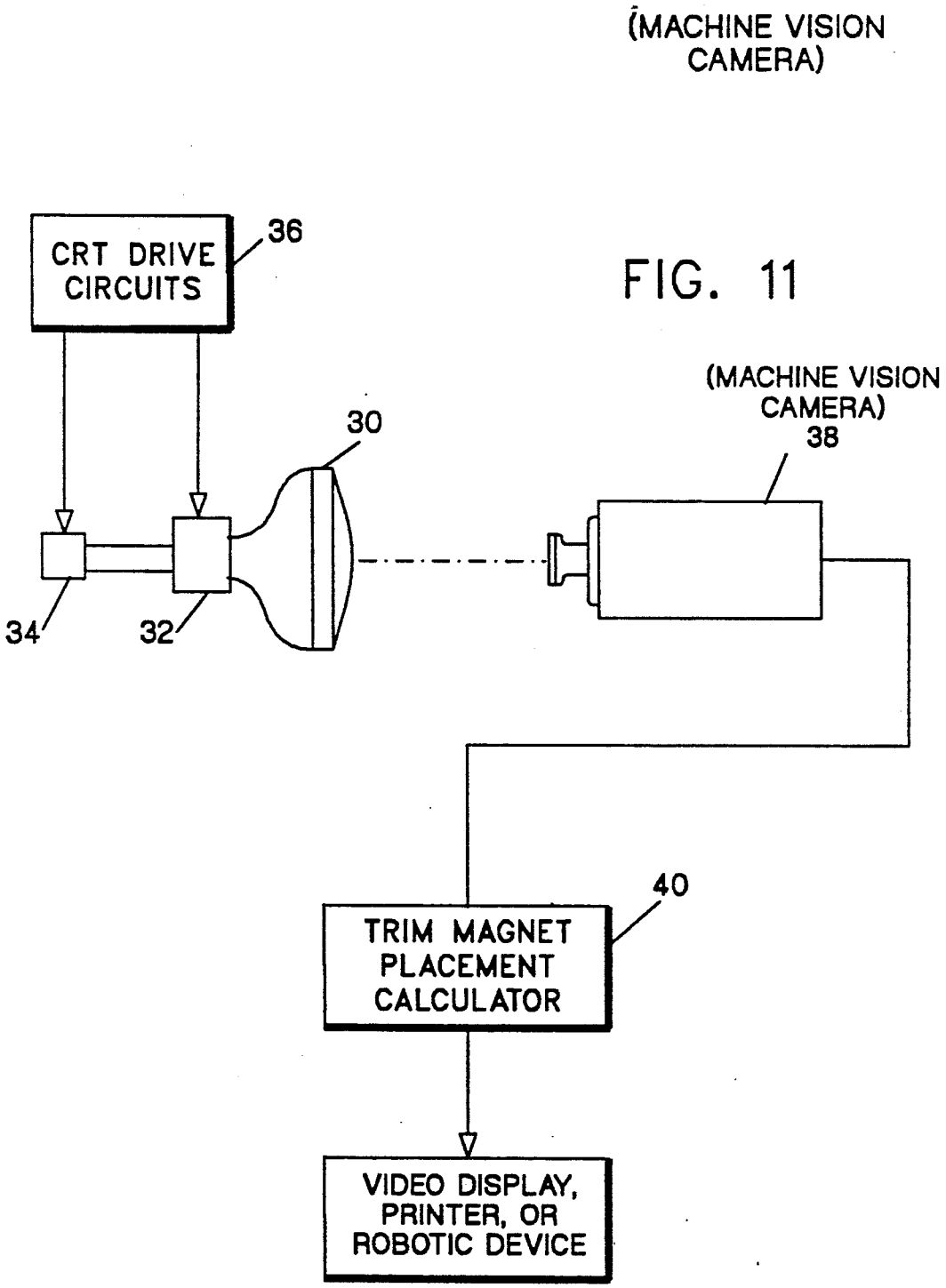
FIG. 11 is a block diagram of a system for performing a computer-aided process in accordance with the present invention.

The apparatus required for performing a computer-aided process for determining placement of trim magnets is shown in FIG. 11. A partially assembled display including at least a cathode ray tube 30, a deflection yoke assembly 32, initially without trim magnets, and an end cap 34 is mounted in a test fixture (not shown). The cathode ray tube is energized through CRT drive circuits 36 which provide drive voltage for the CRT's electron gun through the end cap 34. The circuits 36 also provide horizontal and vertical drive voltages to the deflection yoke 32 to cause the CRT 30 to produce a video raster. The shape of the video raster is determined by using a machine vision camera 38 which measures key points along the edges of the raster area.

The measurements are applied to a trim magnet placement calculator 40 which may be either a specially programmed general purpose computer or special hardware. The calculator 40 uses a process to be described to determine the proper strength and orientation of magnets to be placed in the yoke assembly to reshape the video raster pattern towards the ideal rectangular shape. Device 40 specifies the strength and orientation of the magnet for each position in the yoke. This information can be provided either to a human operator who will select and manually place the specified magnet or, in a fully automated production line, to a robotic device capable of selecting, orienting and installing the proper magnets. Block 41 represents a conventional video display or printer which provides a tangible representation of the data to an operator in a conventional production line. In a fully automated production line, block 41 represents a robotic device capable of responding to signals provided by calculator 40 to select and install the trim magnets on the yoke.

Figure 12:
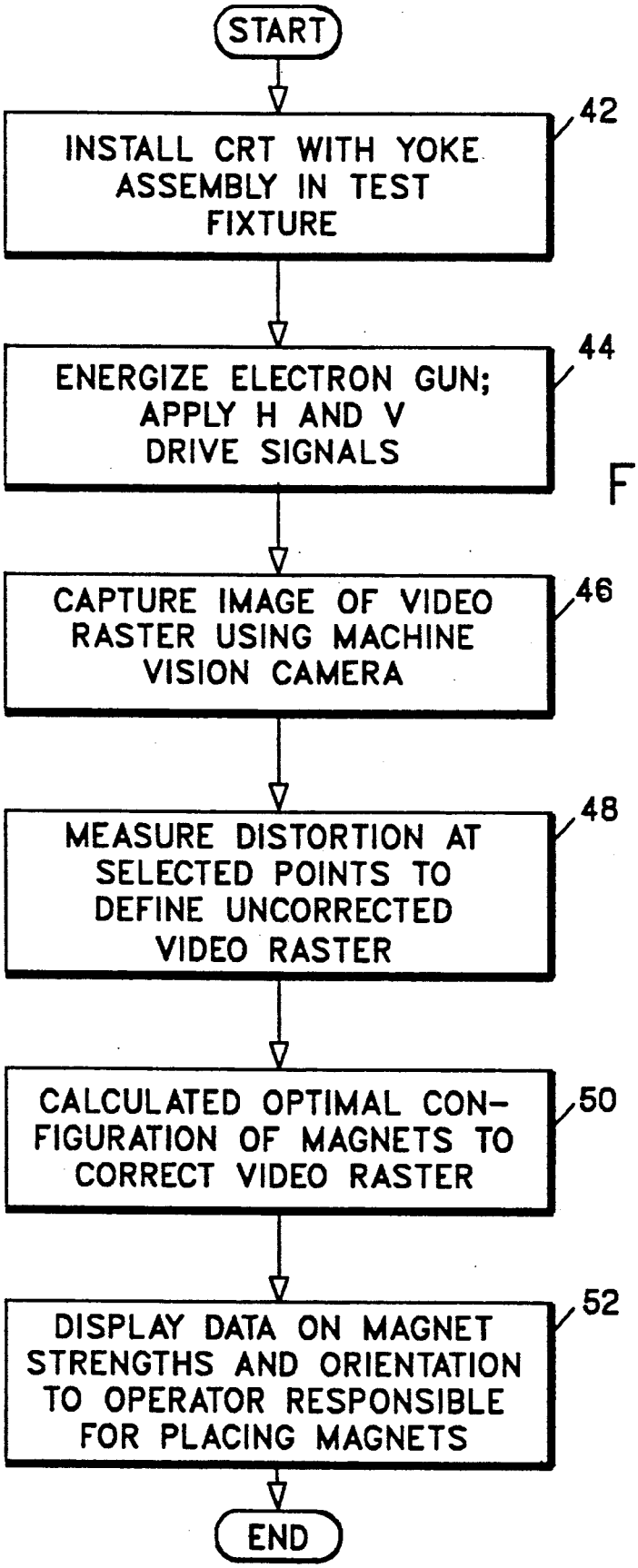
FIG. 12 is a flow chart of the process.

The basic process is described in FIG. 12. In operation 42, the partially assembled CRT display is installed in the test fixture. In operation 44, the electron gun is energized and horizontal and vertical drive signals are applied to the deflection yoke. The machine vision camera captures an image of the video raster in operation 46 through the measurement of key points along the raster. The distortion which exists in the uncorrected video raster is measured at selected points in operation 48 to provide input data for an operation 50 in which the optimal configuration of magnets needed to correct the distortion is calculated. Operation 52 involves the transfer of the optimal configuration information to an operator, either human or robotic, responsible for placing the magnets in the deflection yoke assembly. Where a human operator is employed, the transfer of information would be accomplished by any device capable of producing a tangible representation of the information, such as a conventional video display or printer. Where a robotic device is employed, the transfer of information would take the form of electrical signals delivered to the robotic device to enable the robotic device to perform pre-programmed operations to select and install appropriate trim magnets.

The magnet placement calculation process is structured and solved as a linear optimization problem rather than as an iterative, rule-based problem. The linear optimization approach permits a complete magnet placement solution to be determined with a single calculation rather than a series of iteration between system state and adjustment rules. The process can be considered as having three major components. The first is a set of sensitivity mappings, of the type described above, characterizing the effect of adding individual trim magnets to a display system. The second major component is a distortion measurement which describes the raster shape to be corrected. As noted earlier, the distortion measurement is achieved using a machine vision camera as described earlier. The third major component of the process is a series of transition equations where each equation mathematically describes an objective or a constraint for correcting the distorted raster.

A goal equation is used to express a correction objective for the image. Goal equations generally can be formulated directly from monochrome monitor adjustment specifications; for example, specification definitions for edge straightness, trapezoid correction, and/or parallelogram correction.

Constraint equations are used to express limitations on various types of image alterations. For example, it may be desired to restrict the image correction calculations to prevent alterations in image centering or image aspect ratio when computing a solution to correct for edge distortions.

The process determines an optimal configuration of bar and trim magnets that will correct a distorted video raster, by using the sensitivity values to compute a modification to the measured distortion which best satisfies the goals and constraints set forth in the transition equations. In other words, the process assumes that the effects described by each sensitivity mapping can be added together in different proportions to achieve a net effect which satisfies the given definition of a corrected image.

The algorithms which are employed include a number of variables, most of which are defined in the context of the description. Different units of measure are employed. Specifically: d is in units of distance; g is in units of magnet strength; and s is in units of distance/magnetic strength or sensitivity.

The mechanics of defining the sensitivity of a raster point relative to a named position are as follows. Let $t=1, 2, \ldots, M$ represent M key measurement points along the video raster. Let $i=1, 2, \ldots, N$ indicate N discrete magnet positions/orientations around the yoke perimeter. Suppose that $s^x(t)$ defines the horizontal sensitivity of raster point t with respect to adding a fixed magnet at position i. Similarly, let $s^y(t)$ define the vertical sensitivity of raster point t with respect to magnet position i. Then the vectors $$s_i^x(t)=[s_i^x(1), s_i^x(2), \ldots, s_i^x(M)]^T \text{ and } s_i^y(t)=[s_i^y(1), s_i^y(2), \ldots, s_i^y(M)]^T$$

describe the net vector translation created at each key point t along the raster by adding a single magnet to position i. Since there are N magnet positions defined around the yoke, there will be N such pairs of horizontal/vertical sensitivity arrays.

In discussing distortion measurements, the following definitions are used:

$d^{Ux}(t)$ the horizontal coordinates of the distortion function measured at all points $t$ on an uncorrected display.

-continued $d^{Uy}(t)$ the vertical coordinates of the distortion function measured at all points $t$ on an uncorrected display.

$d^{Ix}(t)$ the horizontal coordinates of the ideal raster shape measured at all points $t$.

$d^{Iy}(t)$ the vertical coordinates of the ideal raster shape measured at all points $t$.

$g^U$ the original strength at all magnet positions $i$.

$g_i^I$ the final magnet strengths at positions $i - 1 \ldots N$ such that $d^U(t)$ is corrected to the ideal rectangular raster $d^I(t)$.

$d^k(t)$ $d^{Ik}(t) - d^{Uk}(t)$ = delta movement for point position $t(k = x,y)$.

$g_i(t)$ $g^I - g^U$ = change in magnet strength at position $i$.

To find $g_1, g_2, \ldots, g_N$ where the $g_i$'s describe the additional magnet strength that must be placed at each yoke position i to best correct the measured distortion $d^U(t)$, the following system of equations must be solved.

$$\begin{aligned}
d^x(1) &= g_1 s_1^x(1) + g_2 s_2^x(1) + \ldots + g_N s_N^x(1) \\
&\vdots \\
d^x(M) &= g_1 s_1^x(M) + g_2 s_2^x(M) + \ldots + g_N s_N^x(M) \\
d^y(1) &= g_1 s_1^y(1) + g_2 s_2^y(1) + \ldots + g_N s_N^y(1) \\
&\vdots \\
d^y(M) &= g_1 s_1^y(M) + g_2 s_2^y(M) + \ldots + g_N s_N^y(M)
\end{aligned}$$

which is identical to solving $$d^{Ik}(t) = d^{Uk}(t) + \sum_{i=1}^{N} g_i s_i^k(t)$$
$$t = 1 \ldots M,\ k = x,y$$

If the specific x and y coordinates of an ideal raster are known, the above set of equations suffice. However, image size and centering on monochrome displays are normally allowed to vary within a tolerance window. Hence, it becomes difficult to predict the exact x,y correction coordinates of an arbitrary distortion. A more practical approach is to express the ideal correction in terms of attributes of a perfect rectangle; that is straight sides, orthogonal edges, and equivalent diagonals. Monochrome front of screen specifications are typically expressed in terms of these types of image attributes.

It is possible to rewrite the above system of equations to reflect the more generic specifications. Each transition relation must be a first order linear equation to conform to a least squares optimization format. That is, each equation must conform to the format:

$$d(z) = \sum_{i=1}^{N} g_i f_i(z)$$

Two examples for deriving transition equations are given below:

Example 1 (Straight Edge Equations): Assume a coordinate system which is orthogonal to the raster. Then a straight vertical edge can be linearly specified by requiring that all horizontal coordinates of the points along that edge be identical. That is, for two points $t=v_1$, $v_2$ which lie along the same vertical edge of the raster, it can be required that:

$$d^{Ix}(v_1)=d^{Ix}(v_2)$$

Two sensitivity equations have already been defined as:

$$d^{Ix}(v_1) = d^{Ux}(v_1) + \sum_{i=1}^{N} g_i s_i^x(v_1) \text{ and}$$

$$d^{Ix}(v_2) = d^{Ux}(v_2) + \sum_{i=1}^{N} g_i s_i^x(v_2)$$

Using the equality assumption of $d^{Ix}(v_1)=d^{Ix}(v_2)$, the two sensitivity relations can be combined by means of subtraction to yield:

$$0 = d^{Ux}(v_1) - d^{Ux}(v_2) + \sum_{i=1}^{N} g_i(s_i^x(v_1) - s_i^x(v_2)) \text{ or}$$

$$d^{Ux}(v_2) - d^{Ux}(v_1) = \sum_{i=1}^{N} g_i(s_i^x(v_1) - s_i^x(v_2)).$$

Note that the resulting equation conforms to the required transition equation format of:

$$d(z) = \sum_{i=1}^{N} g_i f_i(z)$$

where $$d(z)=d^{Ux}(v_2)-d^{Ux}(v_1)$$

$$f_i(z)=s_i(v_1)-s_i(v_2).$$

Additional pairwise relations can be derived in a similar manner to yield a set of goal equations which constrain the algorithm for a straight-edge solution.

Example 2 (Trapezoid Correction): A standard test for identifying a trapezoidal error is to compare the length of opposite edges. Formally, let TR=the Top Right corner point on the image, BR=the Bottom Right corner, TL=the Top Left corner and BL=the Bottom Left image corner. Let $p_1,p_2$ represent the geometric distance from point $p_1$ to point $p_2$. To avoid a trapezoidal image we must have $$\overline{TR,BR}=\overline{TL,BL} \text{ and } \overline{TR,TL}=\overline{BR,BL}$$

A least squares algorithm requires all transition relations be first order linear equations. Thus, the geometric distance from corner to corner on a vertical edge can be approximated as the difference in the y-coordinates of the two corner points. A similar approximation can be applied to the horizontal edges. For the y-coordinates of the four corner points t=TL,BL,TR,BR on an ideal raster, it can be specified:

$$d^{Iy}(TR)=d^{Iy}(BR)=d^{Iy}(TL)-d^{Iy}(BL)$$

using the sensitivity relations:

$$d^{Iy}(TR) = d^{Uy}(TR) + \sum_{i=1}^{N} g_i s_i^y(TR)$$

-continued $$d^{Iy}(BR) = d^{Uy}(BR) + \sum_{i=1}^{N} g_i s_i^y(BR)$$

$$d^{Iy}(TL) = d^{Uy}(TL) + \sum_{i=1}^{N} g_i s_i^y(TL)$$

$$d^{Iy}(BL) = d^{Uy}(BL) + \sum_{i=1}^{N} g_i s_i^y(BL).$$

Combining the above equations in a manner similar to the straight edge derivation yields:

$$0 = [d^{Uy}(TR) - d^{Uy}(BR)] - [d^{Uy}(TL) - d^{Uy}(BL)] + \sum_{i=1}^{N} g_i([s_i^y(TR) - s_i^y(BR)] - [s_i^Y(TL) - s_i^y(BL)])$$

or $$[d^{Uy}(TL) - d^{Uy}(BL)] - [d^{Uy}(TR) - d^{Uy}(BR)] + \sum_{i=1}^{N} g_i([s_i^y(TR) - s_i^y(BR)] - [s_i^Y(TL) - s_i^y(BL)])$$

which once again is of the form $$d(z) = \sum_{i=1}^{N} g_i f_i(z).$$

Recall that the transition equations are of the sum $$d(z) = \sum_{i=1}^{N} g_i f_i(z) = g_1 f_1(z) + g_2 f_2(z) + \ldots + g_N f_N(z).$$

This set of equations might be solved for g by finding an approximation d'(z) to d(z) such that the error $$e'(z)=d(z)-d'(z)$$

is minimized.

Define F(z) to be an M×N matrix such that columns 1, . . . , N are defined by transition vectors $f_i(z)$ and define g to be an N×1 matrix of coefficients $g_i$. If $$F(z)=[f_1(z),f_2(z),\ldots,f_N(z)] \text{ and } g=[g_1, g_2, \ldots, g_N]^T$$

then $$d'(z)=Fg$$

and $$e = \begin{bmatrix} e_1 \\ e_2 \\ \cdot \\ \cdot \\ \cdot \\ E_M \end{bmatrix} = \begin{bmatrix} d_1 \\ d_2 \\ \cdot \\ \cdot \\ \cdot \\ D_M \end{bmatrix} - \begin{bmatrix} f_1(1) & f_2(1) & \ldots & f_N(1) \\ f_1(2) & f_2(2) & \ldots & f_N(2) \\ \cdot & \cdot & \cdot & \cdot \\ \cdot & \cdot & \cdot & \cdot \\ \cdot & \cdot & \cdot & \cdot \\ f_1(M) & f_2(M) & \cdots & f_N(M) \end{bmatrix} \begin{bmatrix} g_1 \\ g_2 \\ \cdot \\ \cdot \\ \cdot \\ g_N \end{bmatrix}$$

Least squares estimation is a linear optimization technique which seeks to minimize the squared error for a linear system of equations. For minimum error energy=$e^Te$, $g=(F^TF)^{-1}F^Td$. If K is defined such that $g=(F^TF)^{-1}F^Td=Kd$ then K is dependent only on the basis functions $F_i(t)$. Thus K can be computed just once in advance and the evaluation for each CRT correction is reduced to a single matrix multiplication. Note: In implementation of this algorithm, an orthogonalization method such as the well-known Gram-Schmidt (or "QR" decomposition) technique should be used to guard against an ill-conditioned F matrix.

Figure 13:
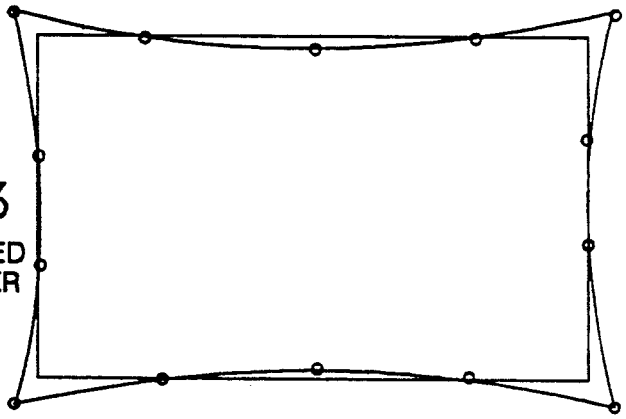
FIG. 13 is an enlarged view of an uncorrected video raster.
Figure 14:
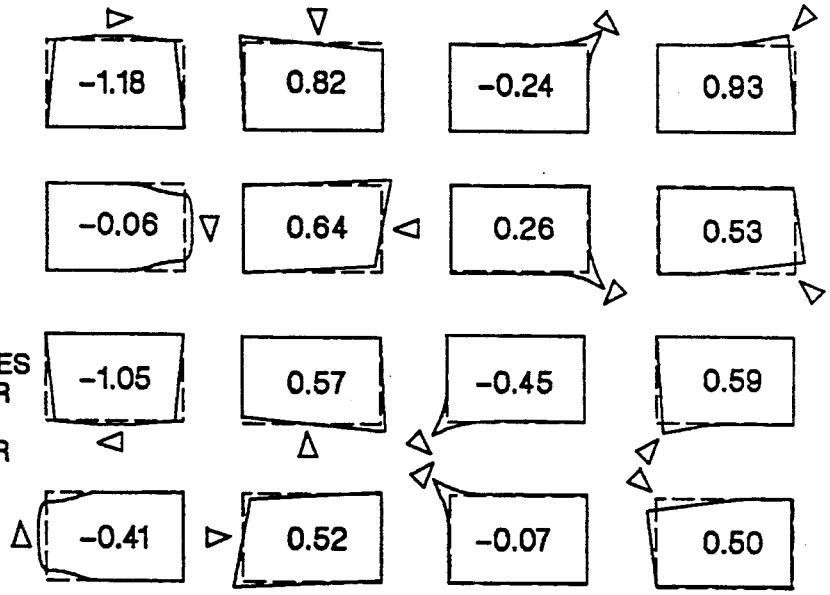
FIG. 14 shows process results representing the relative strengths and orientations of magnetic required to correct the video raster illustrated in FIG. 13.
Figure 15:
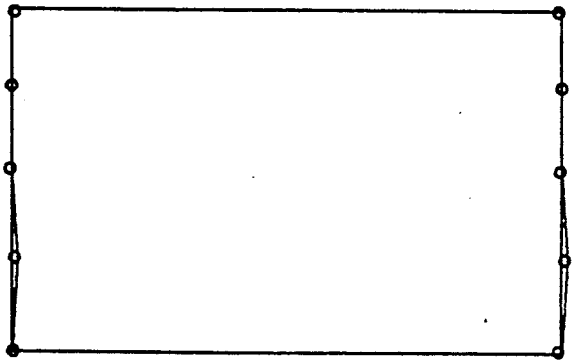
FIG. 15 shows the video raster after correction.

FIGS. 13 through 15 illustrate an application of the above-identified process. FIG. 13 represents an uncorrected video raster superimposed on an ideal, rectangular raster. FIG. 14 shows a least squares solution calculated to correct the raster shown in FIG. 13. The solution was computed using transition equations which constrained edge straightness, edge trapezoid and parallel properties, image centering, image symmetry and image aspect ratio. Each of the solution values can be interpreted as an indication of magnet strength associated with each yoke position. A negative value indicates that the magnet should be rotated 180° from the original basis magnet alignment. For magnet positions for which two magnet orientations (0° and 90°) are computed, a composite angle and magnet strength can be determined by computing the vector sum of the two values.

FIG. 15 shows the resulting raster corrected by applying the solution expressed in FIG. 14 to the uncorrected raster shown in FIG. 13.

While there has been described what is considered to be a preferred embodiment of the present invention, variations and modifications in that embodiment will occur to those skilled in the art once they are made aware of the basic concepts of the invention. For example, it is known that discrete trim magnets can be replaced with shaped magnetic materials, including rings, where regions may be premagnetized. By altering the magnetization in certain regions in the material, magnetic fields can be established that are the full equivalent of those produced by discrete trim magnets.

It is intended that the appended claims shall be construed to include this variation and all other and modifications as fall within the true spirit and scope of the invention.

What is claimed is:

1. A method achieving compensation for image distortion during the manufacture of a cathode ray tube display having a yoke member, said method comprising the steps of:

connecting the cathode ray tube to an energy source before trim magnets are installed on the yoke member;

energizing the cathode ray tube to produce a video raster;

detecting edge distortions in the produced video raster;

employing a distortion correction algorithm and the detected edge distortions to calculate the strength and orientation of one or more trim magnetic fields, which fields, when taken in combination, will minimize the edge distortions; and mounting one or more trim magnets on the yoke member, each of said magnets being of a sufficient strength and being oriented on the yoke member in such a way as to produce one of the trim magnetic fields.

2. A method as defined in claim 1 wherein the step of employing a distortion correction algorithm involves a non-interative algorithm.

3. A method as defined in claim 2 wherein the non-iterative algorithm is a least squares optimization algorithm.

4. A system for determining, during the manufacture of a cathode ray tube display device, appropriate trim magnets to be mounted on a defection yoke assembly in order to reduce image distortion, said system including:

means for energizing the electron gun of a partially assembled cathode ray tube device, said device lacking cathode trim magnetic fields;

means for applying horizontal and vertical deflections signals to deflection windings in the deflections yoke assembly;

means for detecting edge distortions in the video raster produced by the cathode ray tube device;

means responsive to the detected edge distortions for calculating the strength and orientation of one or more trim magnetic fields which, in combination, would be required to compensate for the detected edge distortions; and means for providing a tangible representation of the strength, placement and orientation of each of one or more trim magnets which must be mounted on the yoke assembly in order to produce the calculated rim magnetic fields.

5. A system as defined in claim 4 wherein said edge distortion detecting means comprises a machine vision camera.

6. A system as defined in claim 4 or 5 wherein said calculating means comprises means for providing a non-iterative least squares optimization solution based on the detected edge distortions for the cathode ray tube device.

* * * * *